US010215536B2

(12) United States Patent
Bannon et al.

(10) Patent No.: US 10,215,536 B2
(45) Date of Patent: Feb. 26, 2019

(54) HARD POINT NET

(71) Applicant: Foster-Miller, Inc., Waltham, MA (US)

(72) Inventors: John James Bannon, Merrimack, NH (US); Scott Paul Quigley, Franklin, MA (US)

(73) Assignee: Foster-Miller, Inc., Waltham, MA (US)

( * ) Notice: Subject to any disclaimer, the term of this patent is extended or adjusted under 35 U.S.C. 154(b) by 0 days.

(21) Appl. No.: 15/918,576

(22) Filed: Mar. 12, 2018

(65) Prior Publication Data

US 2018/0306555 A1 Oct. 25, 2018

Related U.S. Application Data

(60) Provisional application No. 62/488,136, filed on Apr. 21, 2017.

(51) Int. Cl.
*F41H 5/02* (2006.01)
*F41H 5/06* (2006.01)
*F41H 5/013* (2006.01)

(52) U.S. Cl.
CPC ..... *F41H 5/026* (2013.01); *F41H 5/013* (2013.01); *F41H 5/06* (2013.01)

(58) Field of Classification Search
CPC ..... F41H 5/026; F41H 5/16
USPC ..... 89/36.02, 36.08, 36.04, 36.01; 245/8; 428/911; 2/2.5
See application file for complete search history.

(56) References Cited

U.S. PATENT DOCUMENTS 1,274,624 A * 8/1918 Steinmetz ..... F42C 15/42 102/409
4,928,575 A 5/1990 Smirlock et al.
5,069,109 A * 12/1991 Lavan, Jr. ..... B63G 9/04 114/240 C
5,170,690 A 12/1992 Smirlock et al.
5,191,166 A 3/1993 Smirlock et al.
5,333,532 A 8/1994 Smirlock et al.
5,578,784 A 11/1996 Karr et al.
6,029,558 A 2/2000 Stevens et al.
6,279,499 B1 8/2001 Griffith, Sr. et al.
6,311,605 B1 11/2001 Kellner et al.
6,957,602 B1 10/2005 Koenig et al.
7,190,304 B1 3/2007 Carlson
7,328,644 B2 2/2008 Vickroy
(Continued)

FOREIGN PATENT DOCUMENTS

DE 691 607 5/1940
WO WO 2006/134407 A1 12/2006
WO WO 2006/135432 A2 12/2006

OTHER PUBLICATIONS

Written Opinion of the International Searching Authority for PCT Application No. PCT/US18/22375 dated May 31, 2018, four (4) pages.

*Primary Examiner* — John Cooper
(74) *Attorney, Agent, or Firm* — Iandiorio Teska & Coleman, LLP

(57) ABSTRACT

An improved hard point net wherein a fabric net has hexagonal net line cells with six nodes. Hard points are attached to the net lines, three per hexagonal cell at every other node thereof such that in each cell there is a node without a hard point between two nodes with hard points and interior cells sharing hard points with all the cells surrounding it. A frame for the net spaces the net and the hard points from a target such as a vehicle.

29 Claims, 7 Drawing Sheets

(56) References Cited

U.S. PATENT DOCUMENTS

| | | | | |
|---|---|---|---|---|
| 8,011,285 | B2 | 9/2011 | Farinella et al. | |
| 8,375,837 | B2 * | 2/2013 | Goossen | F41H 13/0006 244/110 F |
| 8,578,833 | B2 | 11/2013 | Radstake et al. | |
| 8,607,685 | B2 | 12/2013 | Farinella et al. | |
| 8,701,541 | B2 | 4/2014 | Radstake et al. | |
| 9,074,851 | B2 | 7/2015 | Radstake et al. | |
| 9,328,999 | B1 | 5/2016 | Kay | |
| 9,435,615 | B1 | 9/2016 | Kay | |
| 9,835,417 | B1 * | 12/2017 | Kay | F41H 5/026 |
| 2008/0164379 | A1 | 7/2008 | Wartmann et al. | |
| 2009/0217811 | A1 | 9/2009 | Leeming | |
| 2009/0308238 | A1 * | 12/2009 | Schwartz | F41H 5/026 89/36.02 |
| 2010/0288114 | A1 | 11/2010 | Soukos | |
| 2011/0079135 | A1 * | 4/2011 | Farinella | F41H 5/013 89/36.02 |
| 2011/0203453 | A1 * | 8/2011 | Farinella | F41H 5/013 89/36.02 |
| 2014/0224106 | A1 * | 8/2014 | Shackelford | F41H 5/013 89/36.02 |
| 2015/0082977 | A1 * | 3/2015 | Tikochinski | F42B 5/145 89/41.01 |

* cited by examiner

HARD POINT NET

RELATED APPLICATIONS

This application claims benefit of and priority to U.S. Provisional Application Ser. No. 62/488,136 filed Apr. 21, 2017, under 35 U.S.C. §§ 119, 120, 363, 365, and 37 C.F.R. § 1.55 and § 1.78, which is incorporated herein by this reference. This application is also related to U.S. Pat. Nos. 8,607,685 and 8,011,285.

FIELD OF THE INVENTION

The subject invention relates to ordnance shielding.

BACKGROUND OF THE INVENTION

Rocket propelled grenades (RPGs) and other ordnance are used by terrorist groups to target military vehicles and structures. See WO 2006/134407 incorporated herein by this reference.

Others skilled in the art have designed intercept vehicles which deploy a net or a structure in the path of an RPG in an attempt to change its trajectory. See U.S. Pat. Nos. 7,190,304; 6,957,602; 5,578,784; and 7,328,644 all incorporated herein by this reference. Related prior art discloses the idea of deploying an airbag (U.S. Pat. No. 6,029,558) or a barrier (U.S. Pat. No. 6,279,499) in the trajectory path of a munition to deflect it. These references are also included herein by this reference.

Many such systems require detection of the RPG and deployment of the intercept vehicle quickly and correctly into the trajectory path of the RPG.

Static armor such as shown in U.S. Pat. Nos. 5,170,690; 5,191,166; 5,333,532; 4,928,575; and WO 2006/134,407 is often heavy and time consuming to install. When a significant amount of weight is added to a HMMWV, for example, it can become difficult to maneuver and top heavy. Such an armor equipped vehicle also burns an excessive amount of fuel.

Moreover, known static systems do not prevent detonation of the RPG. One exception is the steel grille armor of WO 2006/134,407 which is said to destroy and interrupt the electrical energy produced by the piezoelectric crystal in the firing head of the RPG. Bar/slat armor is also designed to dud an RPG. But, bar/slat armor is also very heavy. Often, a vehicle designed to be carried by a specific class of aircraft cannot be carried when outfitted with bar/slat armor. Also, if the bar/slat armor is hit with a strike, the RPG still detonates. Bar/slat armor, if damaged, can block doors, windows, and access hatches of a vehicle.

Chain link fence type shields have also been added to vehicles. The chain link fencing, however, is not sufficiently compliant to prevent detonation of an RPG if it strikes the fencing material. Chain link fencing, although lighter than bar/slat armor, is still fairly heavy. Neither bar/slat armor nor the chain link fence type shield is easy to install and remove.

Despite the technology described in the above prior art, Rocket Propelled Grenades (RPGs) and other threats used by enemy forces and insurgents remain a serious threat to troops on the battlefield, on city streets, and on country roads. RPG weapons are relatively inexpensive and widely available throughout the world. There are varieties of RPG warhead types, but the most prolific are the PG-7 and PG-7M which employ a focus blast or shaped charge warhead capable of penetrating considerable armor even if the warhead is detonated at standoffs up to 10 meters from a vehicle. A perfect hit with a shaped charge can penetrate a 12 inch thick steel plate. RPGs pose a persistent deadly threat to moving ground vehicles and stationary structures such as security check points.

Heavily armored, lightly armored, and unarmored vehicles have been proven vulnerable to the RPG shaped charge. Pick-up trucks, HMMWV's, 2½ ton trucks, 5 ton trucks, light armor vehicles, and M118 armored personnel carriers are frequently defeated by a single RPG shot. Even heavily armored vehicles such as the M1 Abrams Tank have been felled by a single RPG shot. The PG-7 and PG-7M are the most prolific class of warheads, accounting for a reported 90% of the engagements. RPG-18s, RPG-69s, and RPG-7Ls have been reported as well, accounting for a significant remainder of the threat encounters. Close engagements 30 meters away occur in less than 0.25 seconds and an impact speed ranging from 120-180 m/s. Engagements at 100 meters will reach a target in approximately 1.0 second and at impact speeds approaching 300 m/s.

The RPG-7 is in general use in Africa, Asia, and the Middle East and weapon caches are found in random locations making them available to the inexperienced insurgent. Today, the RPG threat in Iraq is present at every turn and caches have been found under bridges, in pickup trucks, buried by the road sides, and even in churches.

Armor plating on a vehicle does not always protect the occupants in the case of an RPG impact and no known countermeasure has proven effective. Systems designed to intercept and destroy an incoming threat are ineffective and/or expensive, complex, and unreliable.

Chain link fencing has been used in an attempt to dud RPGs by destroying the RPG nose cone. See, for example, DE 691,067. See also published U.S. Patent Application No. 2008/0164379. Others have proposed using netting to strangulate the RPG nose cone. See published U.S. Application No. 2009/0217811 and WO 2006/135432.

WO 2006/134407, insofar as it can be understood, discloses a protective grid with tooth shaped members. U.S. Pat. No. 6,311,605 discloses disruptive bodies secured to armor. The disruptive bodies are designed to penetrate into an interior region of a shaped charge to disrupt the formation of the jet. The shaped charge disclosed has a fuse/detonator mechanism in its tail end. See also Published Patent Application No. 2010/0288114 incorporation herein by this reference. See also U.S. Pat. Nos. 8,701,541; 8,578,833; 9,435,615; 9,074,851; and 9,328,999 incorporated herein by this reference.

SUMMARY OF THE INVENTION

In accordance with one aspect of the subject invention, a new vehicle and structure shield is provided which, in one specific version, is inexpensive, lightweight, easy to install and remove (even in the field), is easy to adapt to a variety of platforms, effective, and exhibits a low vehicle signature. Various other embodiments are within the scope of the subject invention.

The subject invention results from the realization, in part, that a new vehicle and structure shield, in one specific example, features a plurality of spaced rods or hard points held in position via the nodes of a net and used to dud an RPG or other threat allowing the frame for the net to be lightweight and inexpensive and also easily attached to and removed from a vehicle or structure. Due to the configuration of the net and the hard points, less hard points are required resulting in lighter and less expensive systems.

Also, since less hard points are required, there is a lower chance an RPG will strike a hard point head on and detonate.

Featured is an improved hard point net including, in one preferred embodiment, a fabric net having hexagonal net line cells with six nodes, hard points attached to the net lines, three per hexagonal cell at every other node thereof such that in each cell there is a node without a hard point between two nodes with hard points and interior cells sharing hard points with all the cells surrounding it. A frame for the net spaces the net and the hard points from a target.

In one embodiment each hard point of a cell may be shared by two adjacent cells. Each hard point may include a round post portion cut from standard metal rod stock received in a round or hexagonal collar portion cut from standard metal tube stock. The post portion may be between 11 and 21 millimeters in diameter and between 5 and 20 millimeters tall and the collar portion may be between 14 and 24 millimeters in width and between 7 and 22 millimeters tall.

The net may be made of braided line including one or more plies of wire for fire resistance. The nodes of a hexagonal cell may be spaced between 40 and 95 millimeters from each other. The hard points in a hexagonal cell may be spaced between 60 and 120 mm from each other. The net lines may have a breaking strength such that a line will break upon impact of an ordinance fuse with the line for a predetermined percentage of ordinance fuse impacts. The predetermined percent may be 100 percent. The predetermined percentage may be between 80 and 100%. The net lines may have a breaking strength of between 100 lbs and 1,500 lbs. Each hard point may weigh between 10 and 80 grams. Each hard point may weigh between 10 and 40 grams. The net line may have a diameter of between 1.7 and 1.9 mm The invention also features an improved hard point net including a fabric line net having cells with a plurality of nodes, hard points attached to the net lines at every other cell node thereof such that in each cell there is a node without a hard point between two nodes with hard points and interior cells sharing hard points with all the cells surrounding it.

The subject invention, however, in other embodiments, need not achieve all these objectives and the claims hereof should not be limited to structures or methods capable of achieving these objectives.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
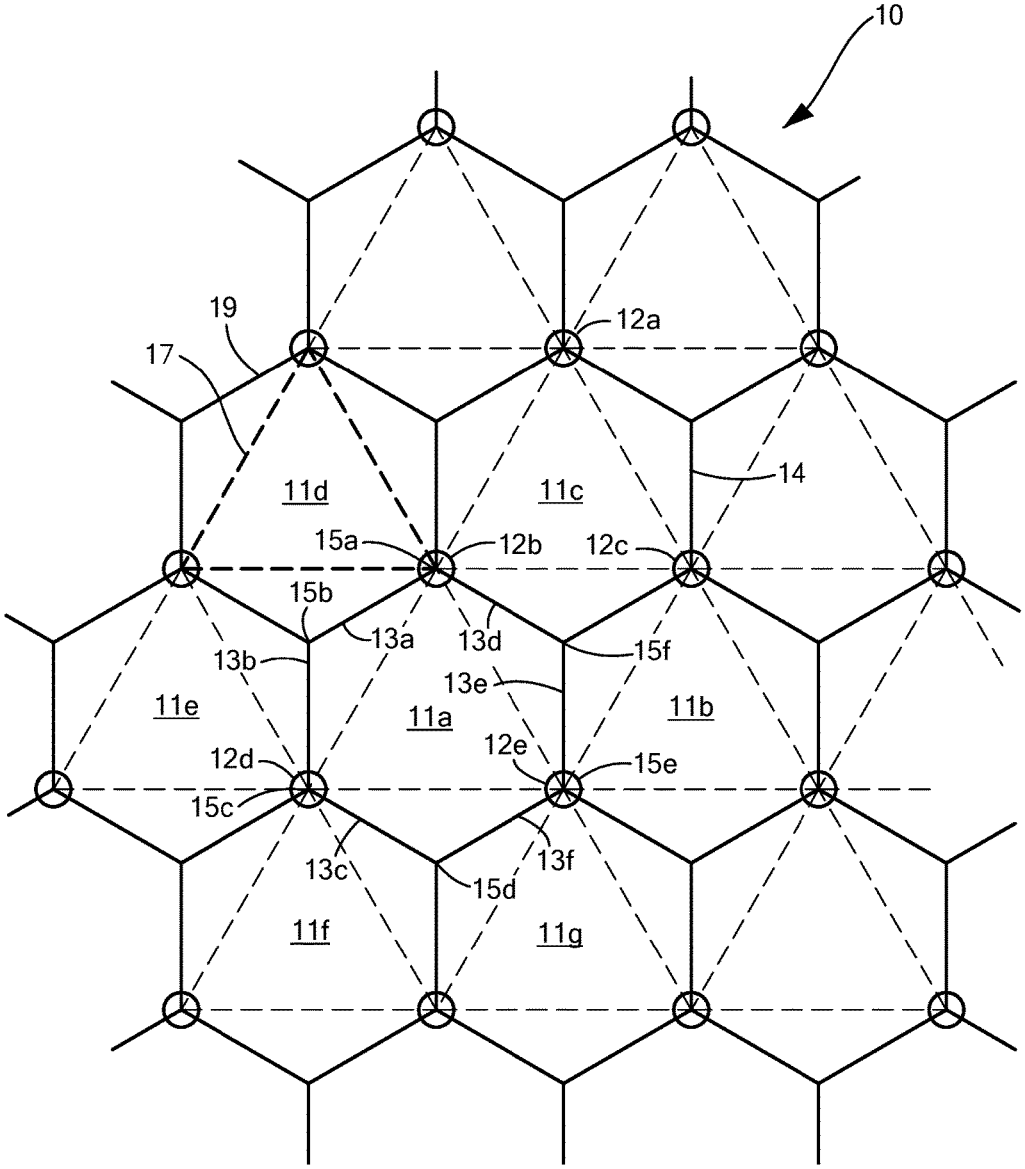
FIG. 1 is a schematic view showing an example of a net configuration in accordance with the invention.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

FIG. 1 shows an example of a net 10 made of fabric lines 14 preferably defining hexagonal cells 11*a*, 11*b*, 11*c* and the like. Thus, each cell has six sides and six nodes as shown for cell 11*a* with sides 13-13*f* and nodes 15*a*-15*f*. In this particular example, three hard points 12 are attached to three nodes of each cell with a node between adjacent hard points free of a hard point. Thus, cell 11*a* includes hard points 12*b*, 12*d*, and 12*e* attached at nodes 15*a*, 15*c*, and 15*e*, respectively and node 15*b* (between nodes 15*a* and 15*c*), node 15*d* (between nodes 15*c* and 15*e*) and node 15*f* (between nodes 15*e* and 15*a*) do not have hard points.

In this fashion, adjacent interior cells preferably share hard points. For example, cell 11*a* shares a hard point with two adjacent cells 11*b*-11*g*. As shown, cell 11*a* shares hard point 12*b* with cells 11*d* and 11*c*, shares hard point 12*d* with cells 11*e* and 11*f*, and shares hard point 12*e* with cells 11*b* and 11*g*.

In this way, the number of hard points can be reduced resulting in a weight savings, a lower cost protective net, and a more effective net since now there is a lower chance than an RPG will strike a hard point head on and detonate. The main purpose of the net is to space the hard points from each other and from the target (e.g., a vehicle or structure). The hexagonal cell net accomplishes this purpose and is effective against RPG threats using less hard points than a net with square or rectangular cells. For example, a 3'×3' net with square cells had between 169 and 289 hard points and a 3' by 3' net with hexagonal cells, as shown in FIG. 1, required only between 120-216 hard points.

The cells may be made of triangular sections as shown for cell 11F. The hard points themselves in each cell are arranged in a triangular fashion as shown by the dash lines for cell 11*d* with the three spaced hard points at the three corners of the triangle 17.

The net is preferably knotless in construction. Each net line 19 may be between 40-95 mm (e.g., 45 millimeters) long between its nodes and thus the adjacent nodes (e.g., nodes 15*a*-15*b* are spaced, for example, 45 millimeters apart. In such a net, the hard points 12*b*, 12*d*, and 12*e* are spaced, for example, 60-120 mm (e.g., 85 millimeters) from each other. The net line material may be fabric, braided or twisted in construction with plies of aramid for strength. In some embodiments, one or more plies of aramid in the braid may be replaced with stainless steel or another wire. In case of fire, then, the net will maintain its integrity and usefulness resulting in a fire resistant net.

Figure 2:
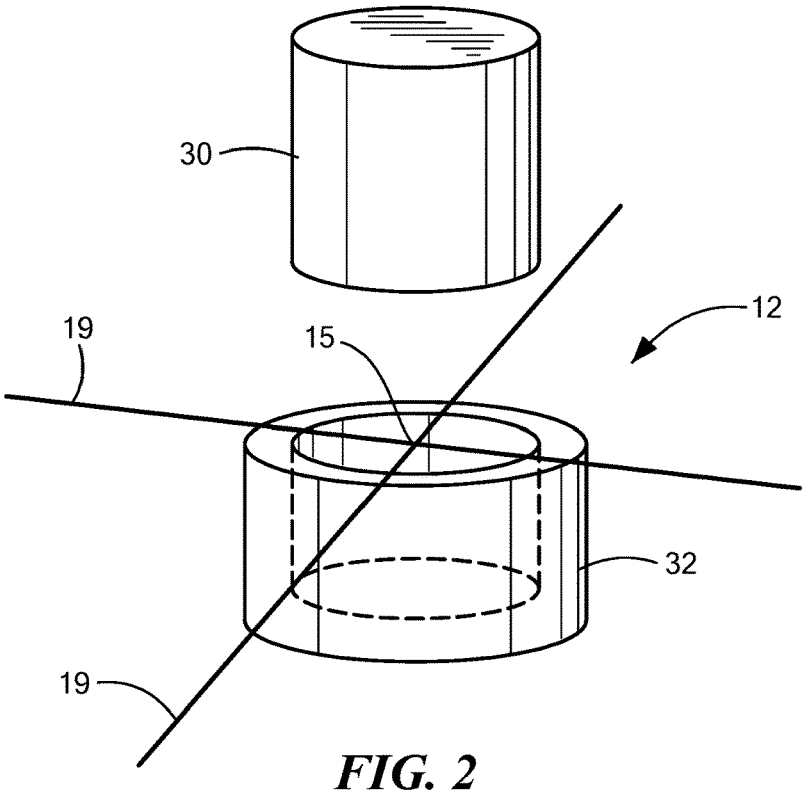
FIG. 2 is an exploded view showing an embodiment of a hard point attachable to the select nodes of the net of FIG. 1.
Figure 3:
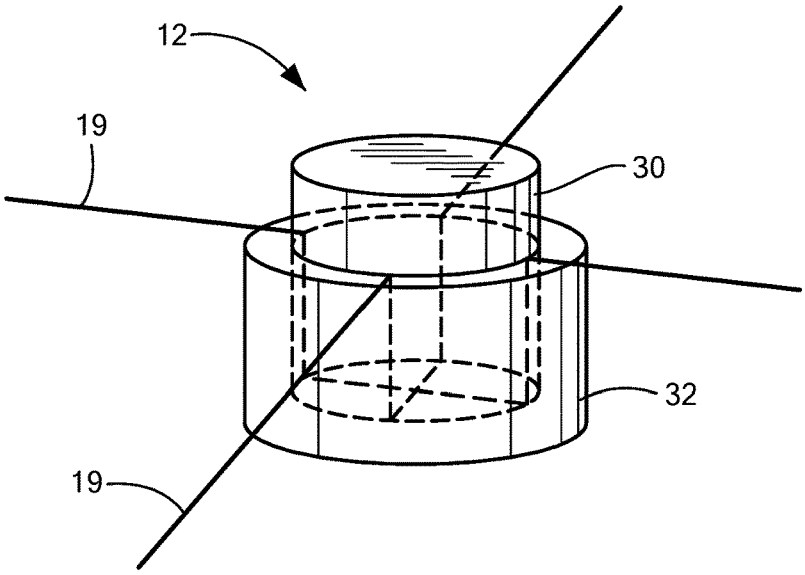
FIG. 3 is a view showing the post portion of the hard point of FIG. 2 now fixed in the collar portion of the hard point.

To further save costs, the hard points 12, FIGS. 2-3 may include round post portion 30 cut from standard metal rod stock and round collar portion 32 cut from standard metal tube stock. Collar portion 32 in another embodiment includes flat sides and may be hexagonal in shape. Post portion 30 is received in collar portion 32 as shown locking a net node therein. Post portion 30 may be between 11-21 mm (e.g., 15 millimeters) in diameter and between 5-20 mm (e.g., 15 millimeters) tall. Collar portion 32 may be between 14-24 mm (e.g., 20 millimeters) in diameter and between 4-22 mm (e.g., 15 millimeters) tall. Other hard point designs are possible. See, for example, U.S. Pat. Nos. 9,435,615 and 8,607,685 incorporated herein by this reference. One preferred hard point is made of steel, has a 25 mm post, and weighs between 15 and 30 grams.

In one specific design, the hard points were made of hardened steel (e.g., ASTM A108 alloy 12L14) and weighed between 10 and 80 grams. The hard points are typically made of conductive material and may include a protective rust resistant non-reflective, conductive coating (zinc plating, flat olive in color). Geomet Coatings (NOF Metal Coatings NA, Chardon, Ohio) may be used.

When an RPG impacts the net, the hard points may angle inwardly towards the nose of the RPG tearing into it and duding the electronics and/or short circuiting electrical or electronic signals associated with the arming or detonation mechanisms of the RPG.

The flexible net can be rolled and then folded and/or can be bunched up. Preferably, net subsystem 10 is removeably secured to a frame 90, FIG. 4 and one or more frames 90 are removeably secured to vehicle or other target as shown in FIG. 5 (e.g., a HMMWV vehicle). In one particular example, the frame members may include hook type fasteners secured to the outside thereof and the net periphery includes fabric with loop type fasteners on the inside thereof. Loop type fasteners may also be secured to the rear of the frame mounting brackets and corresponding pads or patches adhered to vehicle include outer faces with hook type fasteners. The hook and loop fastening mechanisms, however, may be reversed and other flexible fastener subsystems may also be used. The hook and loop fastening subsystems of U.S. Pat. Nos. 4,928,575; 5,170,690; 5,191,166; and 5,333,532 are preferred.

Figure 4:
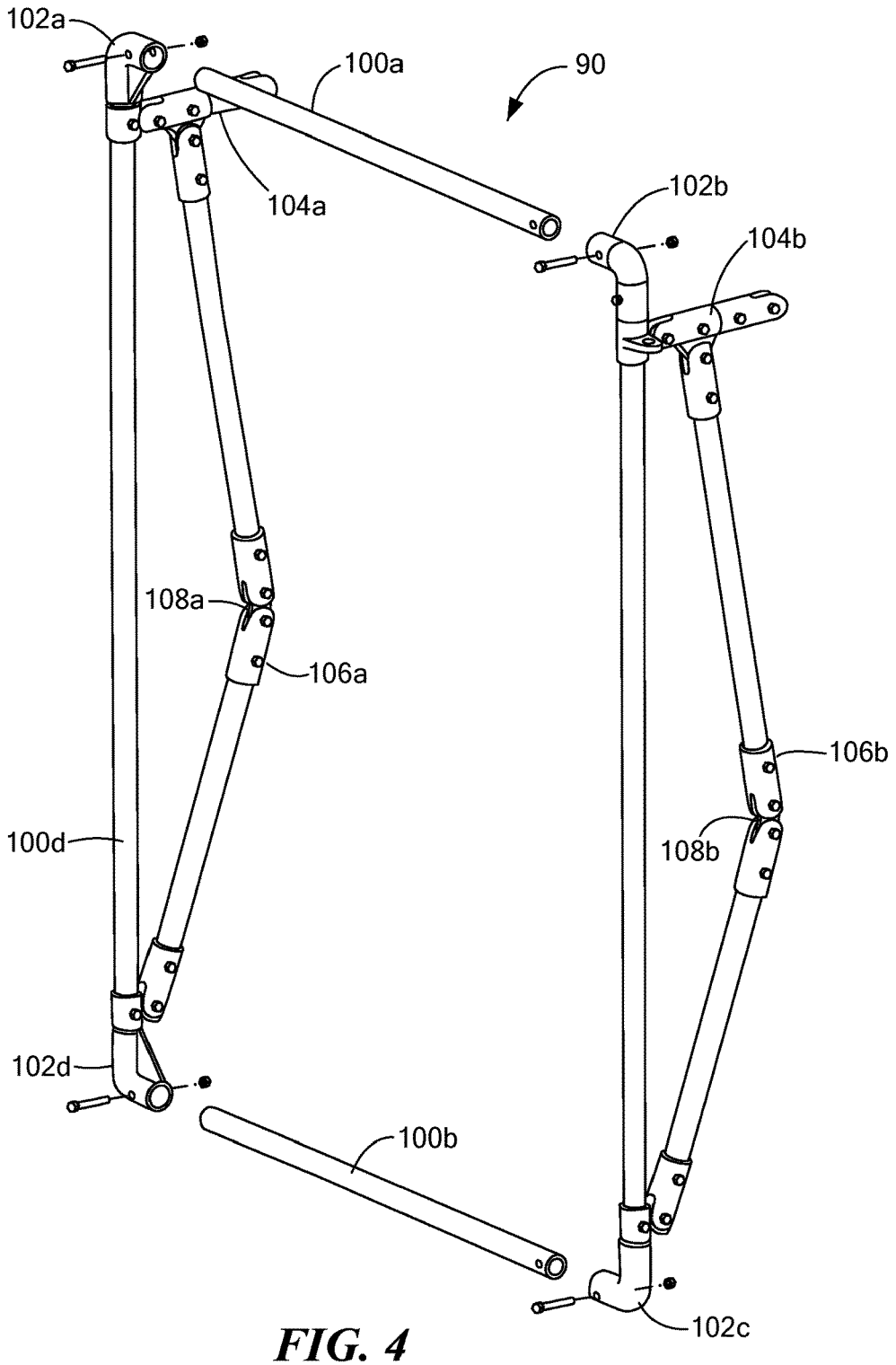
FIG. 4 is a schematic view showing example of a frame useful for spacing the hard point net of FIG. 1 outwardly from a target, for example, a vehicle.
Figure 5:
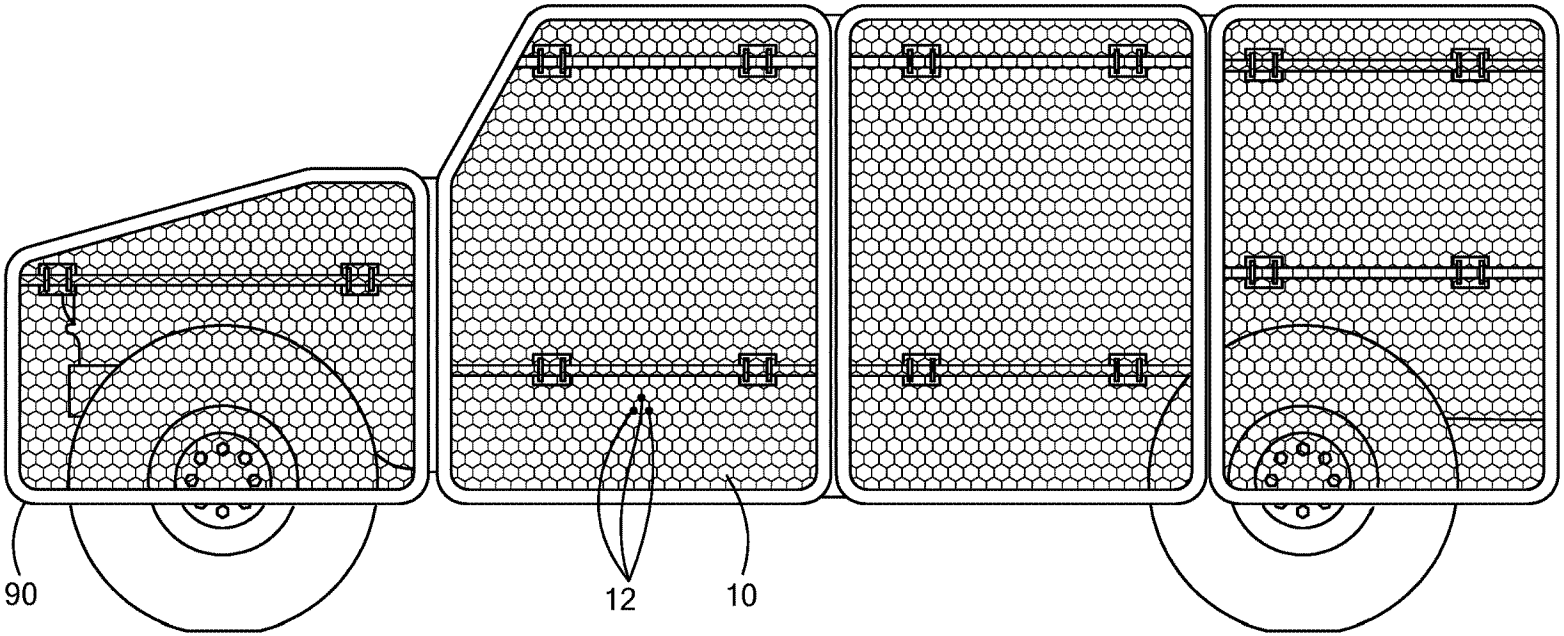
FIG. 5 is a schematic view showing hard point nets in their frames attached to a vehicle.

One design of a frame includes tubular upper frame member 100*a*, FIG. 4, lower frame member 100*b*, and side frame members 100*c* and 100*d* all interconnected via corner members 102*a-d*. The result is a polygon with spaced sides and an upper and lower portion. See FIG. 4.

Rearwardly extending members 104*a* and 104*b* are attached to the upper portion of the members 100*d* and 100*c*, respectively, just below the corner members 102*a* and 102*b*. Rearwardly extending members 106*a* and 106*b* are on each side of the frame and each include a hinged joint 108*a* and 108*b*, respectively. Each of these members extends between a side member at the bottom of the frame and a rearwardly extending member at the top of the frame where they are hingely attached thereto. All of the hinged joints may be pin and clevis type joints as shown.

There are trade offs in the design of the hard points and also the net. The aspect ratio of the hard points, their size, center of gravity, mass, and the like may all play a role. Hard points which are too large, for example, and a net mesh size which is too small, results in too much surface area to be stricken by an RPG fuse, possibly detonating the RPG. Hard points which are too small may not sufficiently damage the RPG ogive and dud the RPG. Steel is a good material choice for the hard points because steel is less expensive. Tungsten, on the other hand, may be used because it is denser, requiring less material, but tungsten is more expensive. Other materials are possible. The hard points may be 1249 mm in diameter and between 12-25 mm tall.

It is preferred that the net node is placed at the center of gravity of the hard point. The length of the hard point is preferably chosen so that when an RPG strikes the net, the pivotable hard point tumbles 90 degrees or so and digs into the RPG ogive. The moment of inertia of the hard point is designed accordingly. In still other designs, the hard point may have six flat sides or more or less than six sides. The hard points may weigh, combined, between 10 to 80 grams, e.g., a 30 gram post portion and a 30 gram collar would provide a 60 gram hard point. Hard points between 10 and 40 grams are typical.

The net material may be polyester which provides resistance to stretching, ultraviolet radiation resistance, and durability in the field. Aramids or other engineered materials can be used. A knotted, knotless, braided or ultracross (knotless) net may be used. In this way, the intersecting lines of the net are connected at the net nodes. The net material diameter may be 1.7 to 1.9 mm. Larger net lines or multiple lines are possible, however, the design should be constrained to beneath threshold force to dynamic break loads typical of RPG impact and engagements.

The preferred spacing or standoff from the net to the vehicle via the frame is between 100-600 mm (e.g., 150-300 mm) but may be between 400-600 mm. Larger standoffs may extend the footprint of the vehicle and thus be undesirable. Too close a spacing may not insure closing of the electrical circuitry of the RPG ogive by the hard points. The frame and mounting brackets are designed to result in the desired spacing.

It is desirable that the net material and mesh size be chosen and the net designed such that an RPG ogive, upon striking a net line, does not detonate. RPGs are designed to detonate at a certain impact force. Preferably, the breaking strength of the net cord material is around 240 lbs so that an RPG, upon striking a string, does not detonate. Breaking strengths below about 1500 lbs are preferred. The net is thus designed to be compliant enough so that it does not cause detonation of the RPG. Instead, the hard points dig into the RPG ogive and dud the RPG before it strikes the vehicle or structure.

This design is in sharp contrast to a much more rigid chain link fence style shield which causes detonation of the RPG if the RPG strikes a wire of the fence. The new design provides more available surface area where duding occurs as opposed to detonation.

FIG. 5 shows shields protecting all of the exposed surfaces of a vehicle. Only a few hard points 12 are shown for clarity.

When an RPG nose or ogive strikes a shield, the rods or hard points preferably angle inwardly toward the nose and tear into the skin thereof. The hard points can bridge the inner and outer ogive serving as short to dud the RPG. Or, the hard points tear into the ogive and the torn material acts as a short duding the round. If the net and/or frame is destroyed, another shield is easily installed. The net thus serves to position the hard points in an array at a set off distance from the vehicle or structure to be protected.

Figure 6:
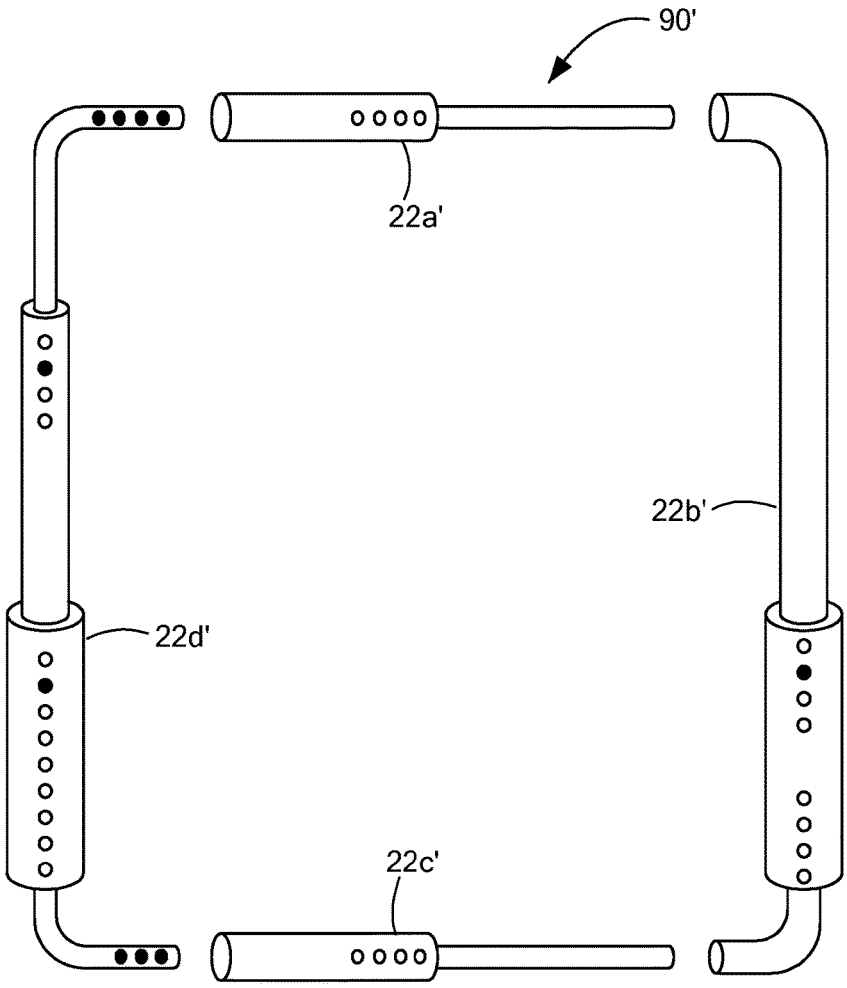
FIG. 6 is a schematic view showing another example of a frame useful in accordance with the subject invention.

FIG. 6 shows how frame 90' members 22*a'* can comprise adjustable length telescoping sections for ease of assembly and for tailoring a particular frame to the vehicle or structured portion to be protected.

In one embodiment, the frame members are made of light weight aluminum. One complete shield with the net attached weighed 1.8 lbs. The shield is thus lightweight and easy to assemble, attach, and remove. If a given shield is damaged, it can be easily replaced in the field. The hard points connected to the net cell nodes are configured to angle inwardly when an RPG strikes the net. This action defeats the RPG by duding it since the electronics associated with the explosives of the RPG are shorted as the rods impact or tear through the outer skin of the RPG ogive.

The result, in one preferred embodiment is an inexpensive and light weight shielding system which is easy to install and remove. The shields can be adapted to a variety of platforms and provide an effective way to prevent the occupants of the vehicle or the structure from injury or death resulting from RPGs or other ordinances. When used in connection with vehicles, the shield of the subject invention exhibits a low vehicle signature since it extends only a few inches from the vehicle.

The system of the subject invention is expected to meet or exceed the effectiveness of bar/slat armor and yet the flexible net style shield of the subject invention is much lighter, lower in cost, and easier to install and remove. The system of the subject invention is also expected to meet or exceed the effectiveness of chain link fence style shields and yet the net/hard point design of the subject invention is lower in cost, lighter and easier to install and remove.

Typically, the frame is attached to the vehicle or structure using metal plates with an ear extending outwardly therefrom. In other instances, however, features already associated with the vehicle or structure to be protected can be used to secure the frame with respect to the vehicle or structure.

Figure 7:
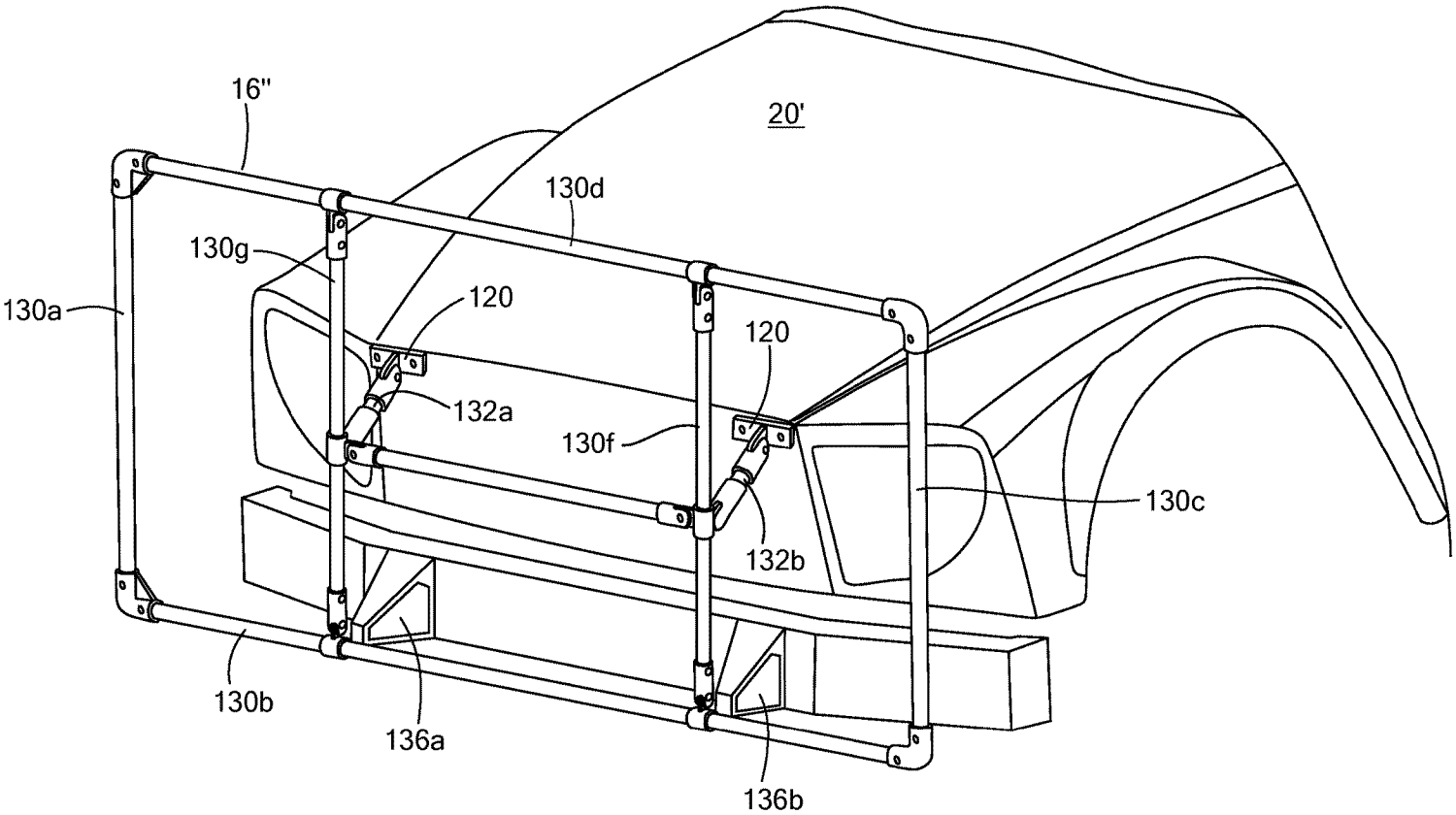
FIG. 7 is a schematic view of a hard point net frame attached to the front of a vehicle.

For example, FIG. 7 shows frame 16" attached to a vehicle. Frame 16" includes frame members 130*a*-130*g*, rearwardly extending members 132*a* and 132*b* hingely connected to plates 120 bolted to the vehicle. Features 136*a* and 136*b* of vehicle 20' are connected to the joints between frame members 130*b*, 130*g* and 130*f*. Thus, the frame, the mounting brackets, and the like may vary in construction depending on the configuration of the vehicle or structure to be protected, the location on the vehicle to be protected and the like. Typically, the frame members are tubular aluminum components and in one example they were 1-2 inches outer diameter, 0.75-1.75 inches inner diameter, and between 3 and 10 feet long.

Figure 8:
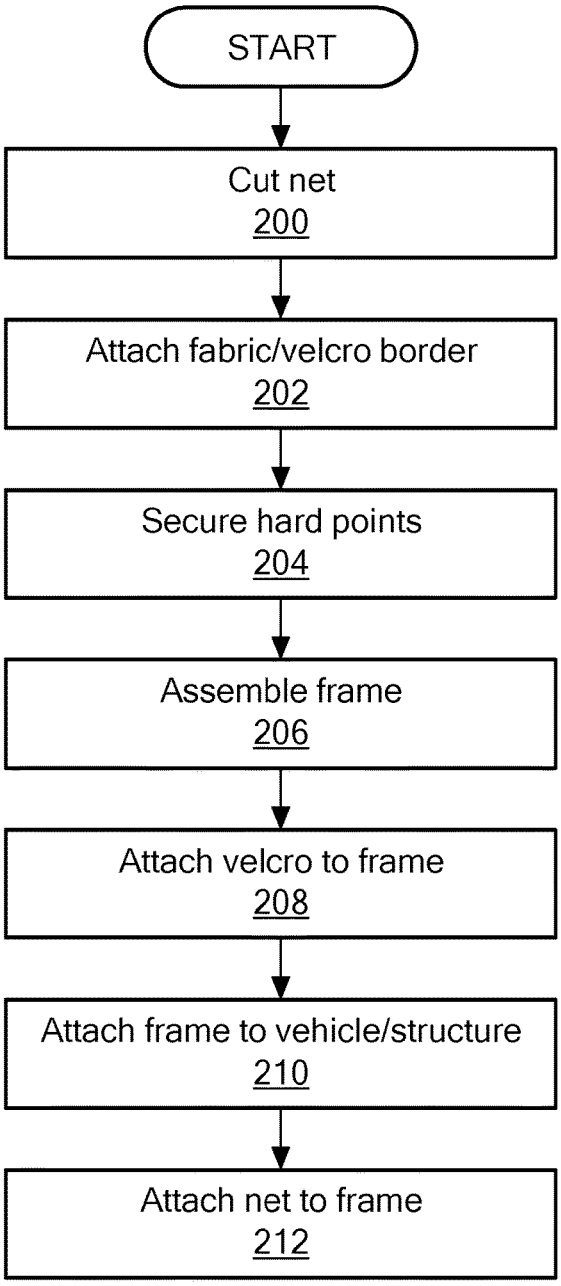
FIG. 8 is a flow chart depicting the primary steps associated with manufacturing of an improved hard point net in accordance with an example of the invention.

Assembly of a vehicle or structure shield, in accordance with examples of the invention, typically begins with cutting the bulk netting, step 200, FIG. 8 into square or rectangular shapes. Next a fabric border is sewed to the net edges, step 202 and includes loop type fastener material on at least one side thereof.

The hard points are then secured to the net nodes, step 204. For example, the net may be laid on a table and hard point collars are positioned under each node. The posts are then driven partly into each collar using finger pressure and/or a hammer. The posts may be seated in their respective cavities using a pneumatic driver.

The appropriate frame is then designed and assembled step 206, FIG. 8 and the hook fastener material is taped or glued to the frame members, step 208. In the field, the frame is secured to the vehicle or structure, step 210, and the net is attached to the frame, step 212, using the loop type fastener material of the net periphery border and the hook fastener material on the frame members. Assembly of the frame to the vehicle or structure and releasably attaching the net to the frame is thus simple and can be accomplished quickly. In one example, the net is attached to the frame in other ways.

As noted above, it is desirable that the net material and mesh size be chosen in the net design such that an RPG ogive, upon striking a net line, does not detonate. RPGs are designed to detonate at a certain impact force. Preferably, the breaking strength of the net line material is designed such that an RPG, upon striking a net line or lines does not detonate.

Preferably, the net line strength for a particular RPG should be less than about 500 lbs resulting in approximately a 100% chance that the line will break upon impact of an RPG fuse with a net line. If higher net strength are desired for a particular application, then a net line strength of 1,000 lbs should not be exceeded in order to insure a chance of between 80% and 100% that an RPG fuse impact with a net line will not cause detonation of the RPG fuse.

Theoretically, a net line strength approaching 0 lbs is preferred to insure no RPGs will detonate when the nose fuse thereof strikes a net line. But, a net must support the hard points in an array in space and also must be sufficiently durable for various missions. So, an engineering tradeoff is made and it has been discovered that net line strengths of between about 200 lbs and 500 lbs results in a sufficiently durable net which does not cause detonation of an RPG when its nose fuse strikes a net line. Instead, the net line breaks. Surprisingly, even if this occurs, the hard points at the net interstices or nodes still dig into the RPG ogive and fairly reliably short the RPG fusing circuitry in a fairly effective manner. For other RPG models, the breaking strength of the net material may be a higher or low based on the fuse sensitivity and the desired percentage of strikes which will not cause detonation of an RPG.

Such a system and method of choosing net material is quite different than prior art net designs without hard points where the net material itself must be sufficiently strong to ensure the nose cone of an RPG is damaged or strangulated before the net strands fail. In the subject invention, in sharp contrast, the hard points function to disarm the RPG rather than the net material which is specifically designed to fail so it does not cause detonation of an RPG if its nose fuse strikes a net strand or line.

Accordingly, in one embodiment, a shield system for an RPG having a particular fuse sensitivity includes a frame, a flexible net subsystem supported by the frame wherein the flexible net subsystem includes lines of net material intersecting at nodes forming mesh openings and hard points attached to at least select nodes. The net material is designed to have a breaking strength such that a line will break upon impact of an RPG fuse with the line for a predetermined percentage of RPG fuse impacts. In the example of an RPG 7, a breaking strength of approximately 500 lbs or less results in an almost 100% chance that the line will break upon impact of an RPG fuse with the line. In one example, net material was chosen such that it had a breaking strength of about 250 lbs. In general, a breaking strength of between 100 lbs-500 lbs is preferred. Net material having a breaking strength of between 500 lbs and 1,000 lbs results in a line breaking upon impact of an RPG 7 fuse with the line for between about 80% and 100% of RPG fuse impacts. A method of fabricating an RPG shield system in accordance with the invention includes determining for an RPG (for example an RPG 7) which net material has a breaking strength such that a net line will break upon impact of an RPG fuse with the line for a predetermined percentage of RPG fuse impacts and then selecting the net material which has a breaking strength such that a line will break upon impact of an RPG fuse with the line for that predetermined percentage of RPG fuse impacts. Hard points are attached to selected net material nodes as discussed above and the net with the hard points attached thereto is attached to a frame as also discussed above.

Although specific features of the invention are shown in some drawings and not in others, however, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

What is claimed is:

1. A hard point net comprising:

a fabric net having hexagonal net line cells with six nodes; hard points attached to the net lines, three per hexagonal cell at every other node thereof such that in each cell there is a node without a hard point between two nodes with hard points and interior cells sharing hard points with all the cells surrounding it; and a frame for the net spacing the net and the hard points from a target.

2. The hard point net of claim 1 in which each hard point of a cell is shared by two adjacent cells.

3. The hard point net of claim 1 in which each hard point includes a round post portion cut from standard metal rod stock received in a round or hexagonal collar portion cut from standard metal tube stock.

4. The hard point net of claim 3 in which the post portion is between 11 and 21 millimeters in diameter and between 5 and 20 millimeters tall and the collar portion is between 14 and 24 millimeters in width and between 4 and 22 millimeters tall.

5. The hard point net of claim 1 in which the net is made of braided line including one or more plies of wire for fire resistance.

6. The hard point net of claim 1 in which the nodes of a hexagonal cell are spaced between 40 and 95 millimeters from each other.

7. The hard point net of claim 1 in which the hard points in a hexagonal cell are spaced between 60 and 120 mm from each other.

8. The hard point net of claim 1 in which the net lines have a breaking strength such that a line will break upon impact of an ordinance fuse with the line for a predetermined percentage of ordinance fuse impacts.

9. The hard point net of claim 8 in which the predetermined percent is 100 percent.

10. The hard point net of claim 8 in which the predetermined percentage is between 80 and 100%.

11. The hard point net of claim 1 in which the net lines have a breaking strength of between 100 lbs and 1,500 lbs.

12. The hard point net of claim 1 in which each hard point weighs between 10 and 80 grams.

13. The hard point net of claim 1 in which each hard point weighs between 10 and 40 grams.

14. The hard point net of claim 1 in which the net line has a diameter of between 1.7 and 1.9 mm.

15. A hard point net comprising:

a fabric line net having cells with a plurality of nodes; hard points attached to the net lines at every other cell node thereof such that in each cell there is a node without a hard point between two nodes with hard points and interior cells sharing hard points with all the cells surrounding it; and a frame for the net spacing the net and the hard points from a target.

16. The hard point net of claim 15 in which each cell forms a hexagon.

17. The hard point net of claim 15 in which each hard point of a cell is shared by two adjacent cells.

18. The hard point net of claim 15 in which each hard point includes a round post portion cut from standard metal rod stock received in a round or hexagonal collar portion cut from standard metal tube stock.

19. The hard point net of claim 18 in which the post portion is between 11 and 21 millimeters in diameter and between 5 and 20 millimeters tall and the collar portion is between 14 and 24 millimeters in width and between 4 and 22 millimeters tall.

20. The hard point net of claim 15 in which the net is made of braided line including one or more plies of wire for fire resistance.

21. The hard point net of claim 15 in which the nodes of a cell are spaced between 40 and 95 millimeters from each other.

22. The hard point net of claim 15 in which the hard points in a cell are spaced between 60 and 120 mm from each other.

23. The hard point net of claim 15 in which the net lines have a breaking strength such that a line will break upon impact of an ordinance fuse with the line for a predetermined percentage of ordinance fuse impacts.

24. The hard point net of claim 15 in which the predetermined percent is 100 percent.

25. The hard point net of claim 23 in which the predetermined percentage is between 80 and 100%.

26. The hard point net of claim 15 in which the net lines have a breaking strength of between 100 lbs and 1,500 lbs.

27. The hard point net of claim 15 in which each hard point weighs between 10 and 80 grams.

28. The hard point net of claim 15 in which each hard point weighs between 10 and 40 grams.

29. The hard point net of claim 15 in which the net line has a diameter of between 1.7 and 1.9 mm.

* * * * *